US007674069B2

(12) United States Patent
Stenzel

(10) Patent No.: US 7,674,069 B2
(45) Date of Patent: Mar. 9, 2010

(54) CONCRETE FINISHING TROWEL

(75) Inventor: Otto W. Stenzel, Neuhütten/Wüstenrot (DE)

(73) Assignee: Wacker Neuson SE, Munich (DE)

( * ) Notice: Subject to any disclaimer, the term of this patent is extended or adjusted under 35 U.S.C. 154(b) by 0 days.

(21) Appl. No.: 11/568,136

(22) PCT Filed: Apr. 22, 2005

(86) PCT No.: PCT/EP2005/004354

§ 371 (c)(1),
(2), (4) Date: Jun. 28, 2007

(87) PCT Pub. No.: WO2005/103413

PCT Pub. Date: Nov. 3, 2005

(65) Prior Publication Data

US 2008/0019774 A1 Jan. 24, 2008

(30) Foreign Application Priority Data

Apr. 23, 2004 (DE) ..... 10 2004 019 866

(51) Int. Cl.
*E01C 19/22* (2006.01)

(52) U.S. Cl. ..... 404/112

(58) Field of Classification Search ..... 404/112; 15/52, 55

See application file for complete search history.

(56) References Cited

U.S. PATENT DOCUMENTS

| | | | | | |
|---|---|---|---|---|---|
| 4,027,991 | A | | 6/1977 | Maass | |
| 4,300,427 | A | * | 11/1981 | Rathert | 83/519 |
| 4,477,203 | A | * | 10/1984 | Laditka | 404/111 |
| 4,577,993 | A | * | 3/1986 | Allen et al. | 404/112 |
| 4,939,872 | A | * | 7/1990 | Revelin et al. | 451/354 |
| 4,958,955 | A | * | 9/1990 | Laditka | 404/75 |
| 5,039,249 | A | | 8/1991 | Hansen et al. | |
| 5,372,452 | A | * | 12/1994 | Hodgson | 404/112 |
| 5,480,258 | A | * | 1/1996 | Allen | 404/112 |
| 5,613,801 | A | * | 3/1997 | Allen | 404/112 |
| 5,685,667 | A | * | 11/1997 | Allen | 404/112 |
| 6,048,130 | A | * | 4/2000 | Allen et al. | 404/112 |

FOREIGN PATENT DOCUMENTS

| | | |
|---|---|---|
| DE | 195 42 728 C1 | 8/1997 |
| EP | 1 069 259 A2 | 1/2001 |

* cited by examiner

*Primary Examiner*—Gary S Hartmann
(74) *Attorney, Agent, or Firm*—Boyle Fredrickson, S.C.

(57) ABSTRACT

A concrete finishing trowel comprising at least one rotor which is mounted on a frame and is provided with a rotatably driven shaft and several blades that are mounted on the driven shaft. A blade deflection mechanism moves the blades on a path that deviates from a circular path relative to the drive shaft.

23 Claims, 9 Drawing Sheets b) m = 4 a) m = 3

CONCRETE FINISHING TROWEL

BACKGROUND OF THE INVENTION

1. Field of the Invention

The present invention relates to a concrete finishing power trowel.

2. Description of the Related Art

Such a power trowel is used predominantly for finishing concrete surfaces, in particular floors, as long as the concrete has not yet hardened. In practice, in addition to manually guided power trowels, ride-on power trowels have proved useful, in which an operator can sit on the device itself and drive it over the concrete that is to be smoothed. In addition to the increased comfort, this makes it possible to avoid leaving footprints on the still-soft concrete surface. Also, in a riding power trowel the weight of the operator sitting on the device provides additional support for its smoothing function.

A power trowel is standardly made up of a frame in which a drive mechanism is housed. The drive drives a rotor, or, in the case of riding power trowels, at least two rotors, each rotor having a drive shaft that is driven by the drive; rotor blades are attached to each drive shaft. The rotor blades extend essentially horizontally, so that the device as a whole sits with the rotor blades on the concrete surface that is to be smoothed. The rotor blades are set into rotation by the drive, and sweep over the surface that is to be smoothed. Because the pitch angle of the rotor blades relative to the drive shaft that bears them can be set, it is possible to achieve a differential pressure effect. Thus, the operator can first cause the rotor blades to sweep over the fresh concrete surface with a relatively flat attack angle and low rotational speed, whereas shortly before the end of the hardening process a higher local pressure, with a significantly steeper attack angle, can be applied to the surface in order to polish it. The setting of the attack angle of the individual rotor blades takes place with the aid of a known blade adjustment device, with which the operator can influence the setting of the rotor blade e.g. via a setting crank.

FIG. 1 shows such a power trowel, as is also known from U.S. Pat. No. 6,368,016 B1. This is a riding power trowel, shown in a schematic perspective view.

On a frame designated 1 as a whole, a seat 2 is situated on which an operator or driver can be seated. Under seat 2 there is situated a drive (not shown), e.g. an internal combustion engine, to which fuel can be supplied via a filling connector 3.

Underneath frame 1, two rotors 4, 5 can be seen. Rotors 4, 5 each have a drive shaft 6 and a plurality of blades 7 (in FIG. 1, each rotor has four blades). Rotors 4, 5 are driven by the drive so as to rotate in opposite directions.

Around rotors 4, 5, a safety cage 8 made up of a plurality of bearing and plate elements is situated in order to prevent accidental intervention in the rotor area, or to prevent driving over the feet of a person standing near the power trowel.

The various possibilities for setting the attack angle of blades 7 are described in U.S. Pat. No. 6,368,016 B1, so that description in more detail is not necessary here.

As is shown, blades 7 are moved rotationally with drive shaft 6 that bears them, so that blades 7 execute a circular movement relative both to drive shaft 6 and also to the surface (concrete surface) that is to be compacted.

In the corners of rooms, there is the problem that blades 7 cannot penetrate all the way into the corner, but rather leave a large area unsmoothed. This area must then be post-processed by hand, which can result in poorer quality of the surface smoothness, and in general entails an increased operating expense.

OBJECT OF THE INVENTION

The present invention is based on the object of improving a power trowel in such a way that corner areas can be better smoothed.

A power trowel according to the present invention has a blade deflection device by which the blades, when they are rotated by the drive shaft, can be moved along a path that deviates from a circular path, relative to the surface being smoothed.

In particular, the blade deflection device achieves that the blades can be displaced outward periodically, preferably along their longitudinal axis, i.e., along the axle with which they are fastened to the drive shaft, or that extends from the blade fastening point to the blade tip. The longitudinal axis of the blade thus stands essentially radial to the axis of rotation of the drive shaft. In this way, in the area of a corner the blades can be moved out of their zero or initial position, while in other rotational positions they can be moved back again, and in some circumstances can even move on a circular path in the remaining area of rotation.

Depending on the deflection of the blades, it is thus possible to completely smooth a corner area.

The solution according to the present invention can be used both with manually guided power trowels having one rotor and also with riding power trowels having two or more rotors.

In an advantageous construction of the present invention, the rotor having the drive shaft and the blades is able to be periodically moved by the blade deflection device out of a null position in which the rotation of the blades would describe a circular path relative to the surface. The null position is accordingly the standard initial position in which the blades rotate completely normally on a circular path, as in the prior art. The blade deflection device now displaces the rotor in such a way that the blade assembly is periodically pushed into the corner, and is drawn out of the corner upon further rotation. The outer ends of the blades, i.e. the blade tips, advantageously have an incline of approximately 45% to the blade radius.

The period of the deflection can correspond to one time, two times, three times, or four times the frequency of the blade rotational speed.

In another specific embodiment of the present invention, the blades are able to be moved by the blade deflection device on a path that deviates from a circular path relative to the drive shaft. Thus, while in the previously described specific embodiment the rotor as a whole, including the drive shaft, was deflected from a null position, in the specific embodiment that is now to be explained the drive shaft alone remains in the standard initial or null position, while during their rotation about the drive shaft the blades are displaced along their longitudinal axis by the blade deflection device in such a way that they do not follow a circular path.

In a particularly advantageous development of the present invention, the blade deflection device has a hypocycloid transmission. A hypocycloid is a line of movement of a point on the edge of a wheel that rolls without slippage along the inner surface of a bore. The diameter of the bore should be a whole-number multiple that of the wheel. If a point on the wheel is regarded that is situated not on the edge of the wheel but radially further inward, what is called a shortened hypocycloid results.

The hypocycloid transmission has a hollow wheel (corresponding to the bore) held on the frame, whose center axis coincides with the axis of rotation of the drive shaft. In the interior of the hollow wheel, a plurality of inner wheels (corresponding to the above-described wheel) revolve, each of which is allocated to one of the blades. The number of inner wheels thus corresponds to the number of blades; the use of three to six blades can be useful.

The inner wheels are borne by a wheel bearer, e.g. a disk or a hub.

In addition, a guide device is provided by which, for each blade, a radial component (relative to the axis of rotation of the drive shaft) of the movement of a guide point provided on the side of the inner wheel belonging to the blade can be transmitted to the associated blade. This means that during the rotation of the blades about the drive shaft, the inner wheels rotate with the blades, and thus roll in the inside of the hollow wheel. This causes the inner wheels to rotate, so that a guide point defined on the lateral surface (edge) of each inner wheel describes a hypocycloid. The radial component of this movement of the guide point is transmitted to the respectively associated blade, so that at defined points the blades move radially outward and subsequently move inward again. In this way, without a large control expense it can be realized that the blades smooth relatively sharply bounded, pointed areas. The angle of these areas is dimensioned in such a way that the blades can comfortably enter corners.

For the blade deflection device, it is particularly advantageous if the diameter of the inner wheel is one-third or one-fourth of the bore diameter of the hollow wheel.

Advantageously, the hollow wheel and the inner wheels are toothed wheels that engage with one another, so that slippage can be avoided.

In a particularly advantageous development of the present invention, what is known as the guide point can be adjusted to various locations having differing radial distances from the axis of rotation of the inner wheel, in order in this way to produce different (shortened) hypocycloids. If the guide point is able to be adjusted to the location of the axis of rotation of an inner wheel, it no longer describes a hypocycloid, but rather a simple circular movement, so that the blades are also moved on a circular path about the drive shaft.

The transmission of the movement of the guide point to the blade allocated thereto can easily be realized mechanically. For example, the guide device can have tappets that are fastened to the inner wheels at the guide points on each wheel, and that engage in the blades.

The movement of the blades can be supported if they are guided in a connecting link at their end oriented toward the drive shaft. Understandably, the shape of the connecting link should be adapted to the selected hypocycloid. Alternatively, a connecting rod could be used.

In a variant of the present invention, the blade deflection device has a connecting link guide situated coaxial to the drive shaft, as well as, for each blade, a rocker arm device, made up preferably of two oscillating levers. Each blade is guided along its longitudinal axis by the oscillating lever device. The oscillating levers of the oscillating lever device are in turn guided in the connecting link guide in such a way that a radial component, relative to the axis of rotation of the drive shaft, of the movement to which the oscillating levers are compelled by the connecting link guide is able to be transmitted to the respective blades guided by these oscillating levers. If two oscillating levers are provided for each blade, these represent a kind of parallel guide device for the blades. During the rotation of the blades, they travel in the connecting link and execute the movement that the connecting link guide compels them to execute, which is in turn transmitted to the blades.

In another specific embodiment of the present invention, the blade deflecting device has power drives that are individually allocated to the blades. This means that each blade is individually capable of being displaced along its longitudinal axis in its radial position relative to the drive shaft, when the power drive allocated to it is activated.

The power drives are capable of being controlled by a control device, so that their activation, and thus the respective blade position, can be coordinated with the rotational position of the rotor. The control device makes it possible very comfortably to realize almost arbitrary movement paths of the blades.

In a particularly advantageous development, a distance sensor device is provided with which the distance of an obstacle from the power trowel can be recognized. This can for example be an ultrasound sensor or a radar device, used increasingly in recent years for example as an electronic parking aid in passenger vehicles (e.g., the "Parktronic" system of the Mercedes-Benz Company). It is particularly useful if the distance sensor device has a plurality of sensors that are distributed around the power trowel so that obstacles can be reliably recognized. However, simple mechanical sensors can also be used.

Given a suitable distribution of the sensors, it is possible to evaluate the corresponding signals using a corner recognition device in such a way that the presence of a corner and its position relative to the position of the frame of the power trowel can be recognized. This information can be provided to the control device, which in turn controls the power drives in such a way that the rotating blades are pushed into the corner as far as possible, in order in this way to smooth the largest possible area of the corner.

These and additional advantages and features of the present invention are described in more detail below with the aid of the accompanying Figures.

DETAILED DESCRIPTION OF THE PREFERRED EMBODIMENT

Figure 1:
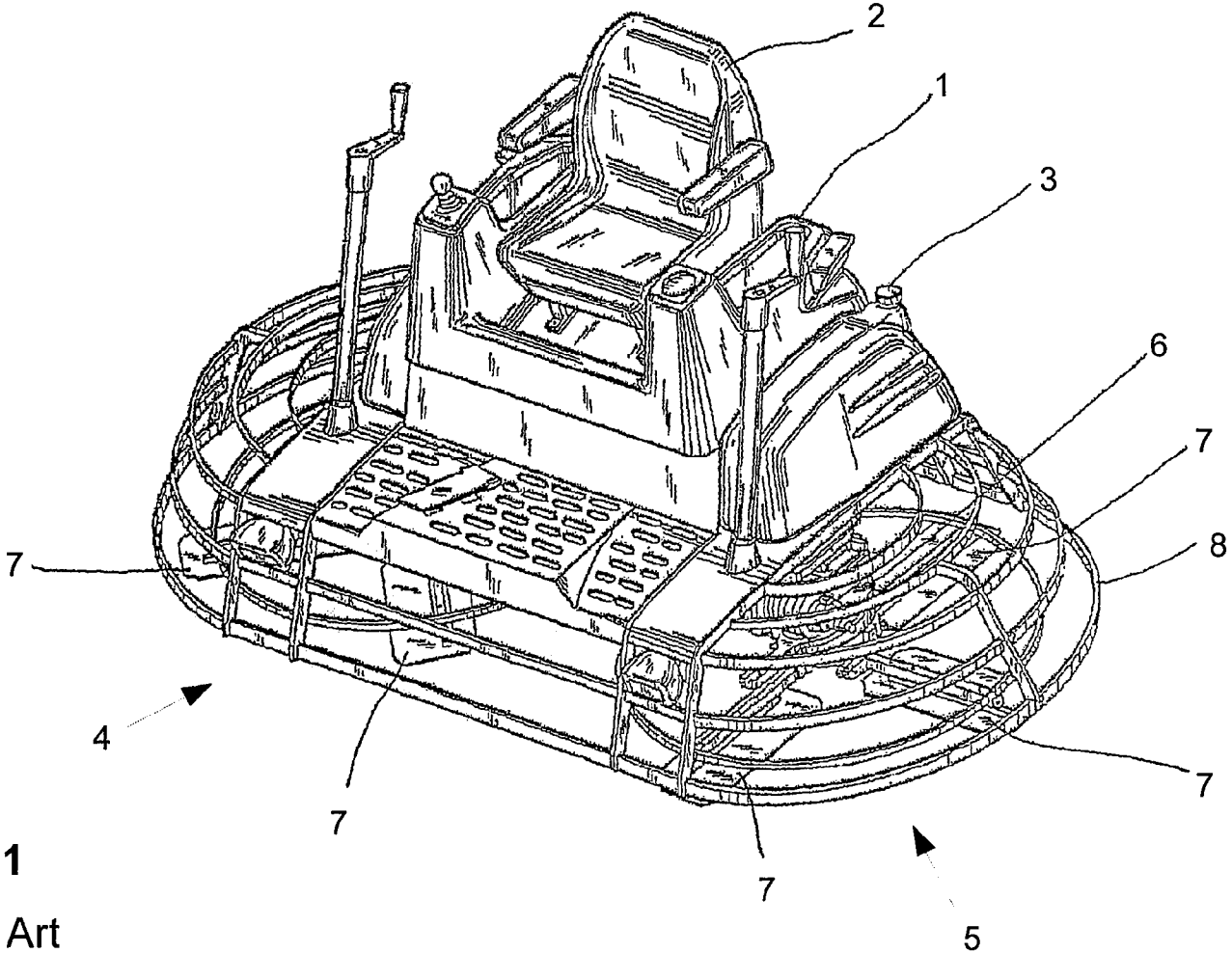
Fig. 1 Prior Art
FIG. 1 shows a perspective view of a known riding power trowel and is appropriately labeled "APRIOR ART"

A power trowel has already been described above on the basis of FIG. 1 in connection with the prior art. The area of rotors 4, 5 is relevant for the present invention, in particular with respect to the interplay of drive shaft 6 and blades 7 held thereon.

Figure 2:
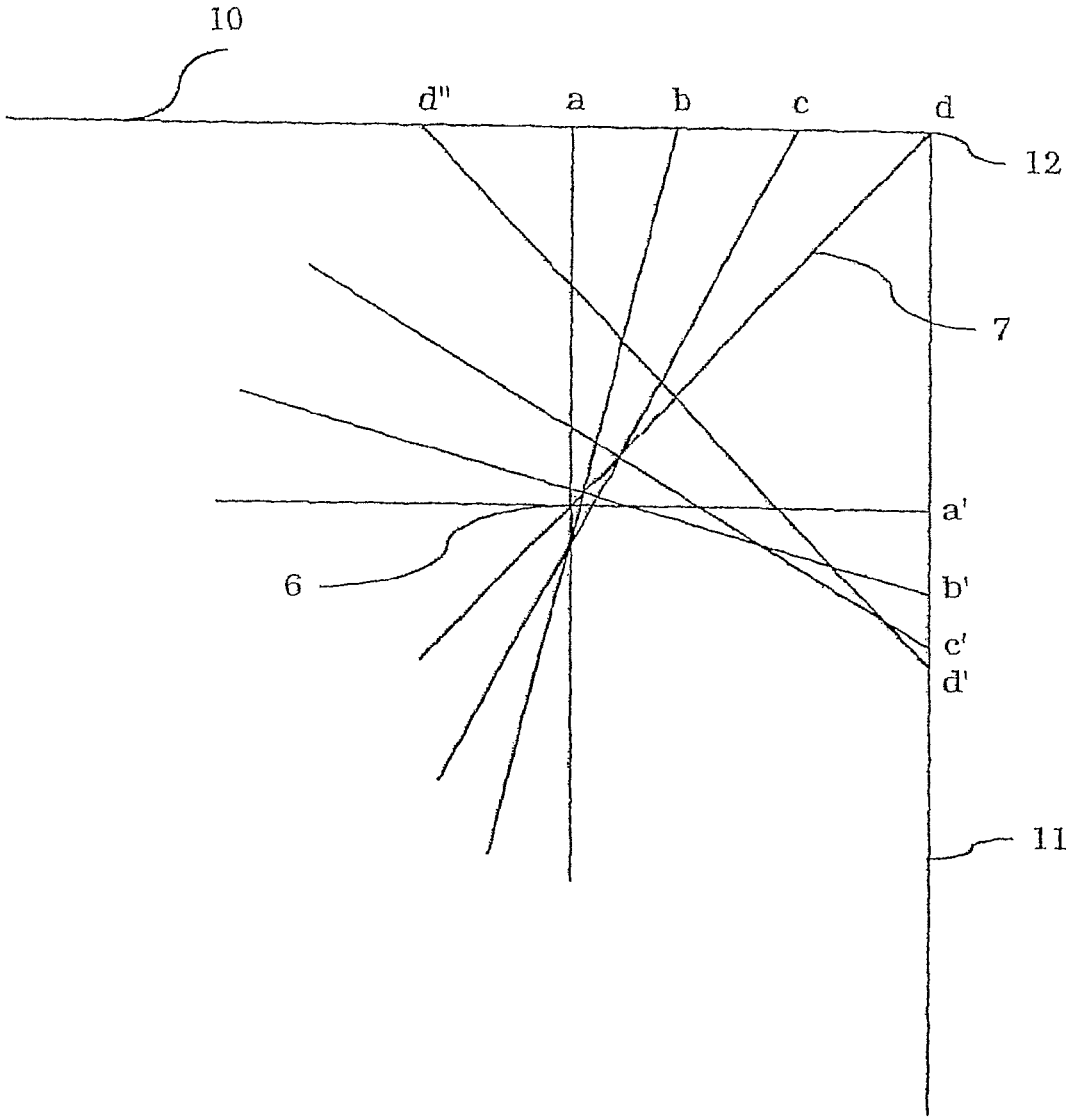
FIG. 2 shows various positions of a blade assembly in a first specific embodiment of the present invention.

FIG. 2 schematically shows the movement of a rotor in a first specific embodiment of the present invention, in which the rotor as a whole (e.g. rotor 4 in FIG. 1) is periodically—with four times the frequency of the rotational speed of the rotor or of the blades—pushed in linear fashion into a corner 12 that is to be smoothed, and is withdrawn from this corner.

For this purpose, in FIG. 2 four positions of the rotor, in particular of the schematically depicted four blades 7, are shown. Let position a, a', in which the respective ends a, a' of two of the four blades 7 stand perpendicular to the two walls 10, 11 that form corner 12, be designated the initial position.

While the rotor executes a rotation of 15° into position b, b', its midpoint (drive shaft 6, schematically shown), is displaced in the direction of corner 12 along a straight line that runs from initial point 6 to corner 12. The displacement of drive shaft 6 on the straight line in the direction of corner 12 increases when there is additional rotation by 15° (rotational position c, c'), until finally, after an overall rotation of 45°, the position d, d is reached, in which a blade tip (reference character d) has precisely reached corner 12.

Upon further rotation, drive shaft 6 must be moved along the straight line out of corner 12 back into the initial position, corresponding to position a, a', while the rotation of the rotor with blades 7 continues.

The deflection of the rotor can take place with the aid of correspondingly controlled power drives.

In a second specific embodiment of the present invention, the blade deflection device 30 has a hypocycloid transmission 40. If a wheel rolls without slippage on the inner surface of a bore, a point on the edge of this wheel executes a hypocycloid as its movement line. The diameter of the bore must be a whole-number multiple of the diameter of the wheel.

Figure 3:
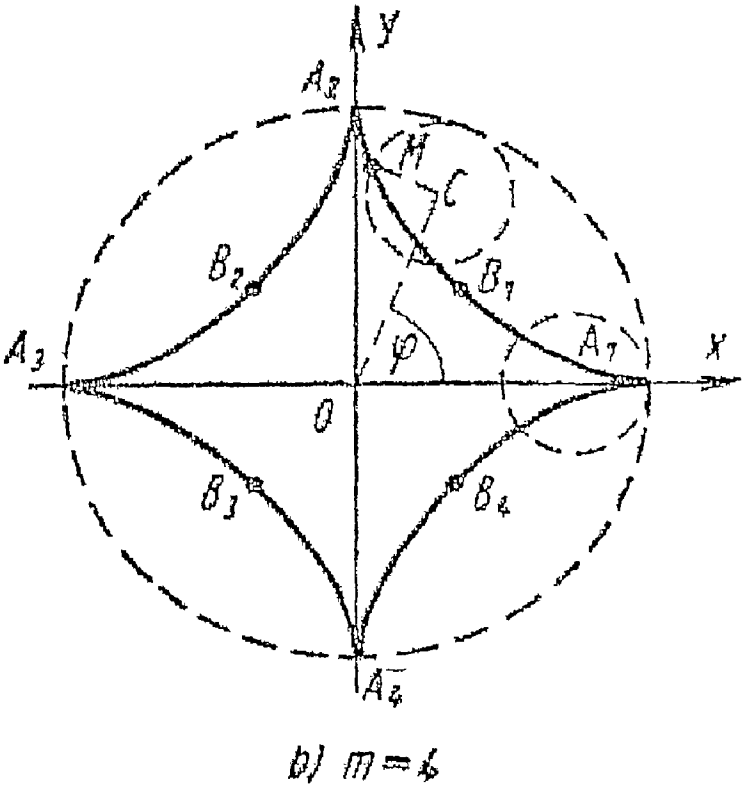
FIG. 3 schematically shows the development of a hypocycloid.
Figure 3:
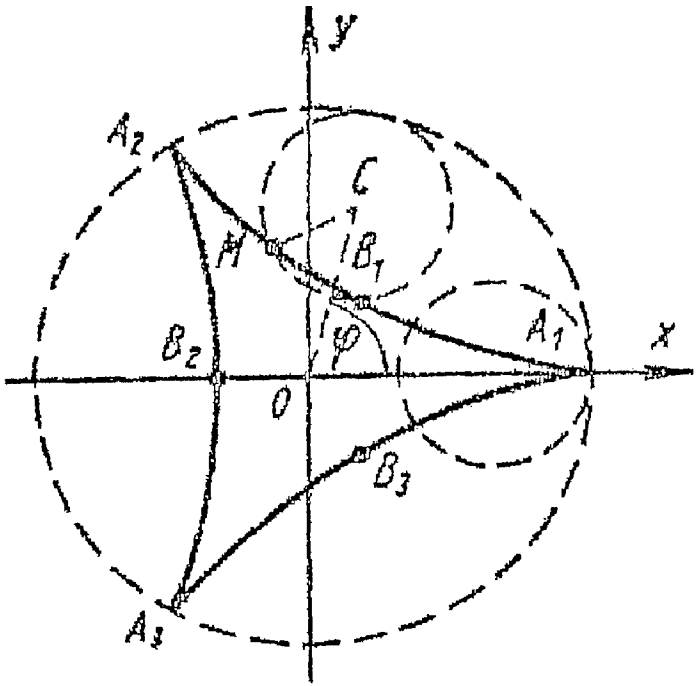

FIG. 3*a*) shows a hypocycloid in which the diameter of the small (dotted-line) wheel is one-third the diameter of the (dotted-line) bore. The hypocycloid has three reverse points.

In FIG. 3*b*), the diameter of the small wheel is one-fourth the diameter of the bore, so that a hypocycloid having four reverse points results.

Figure 4:
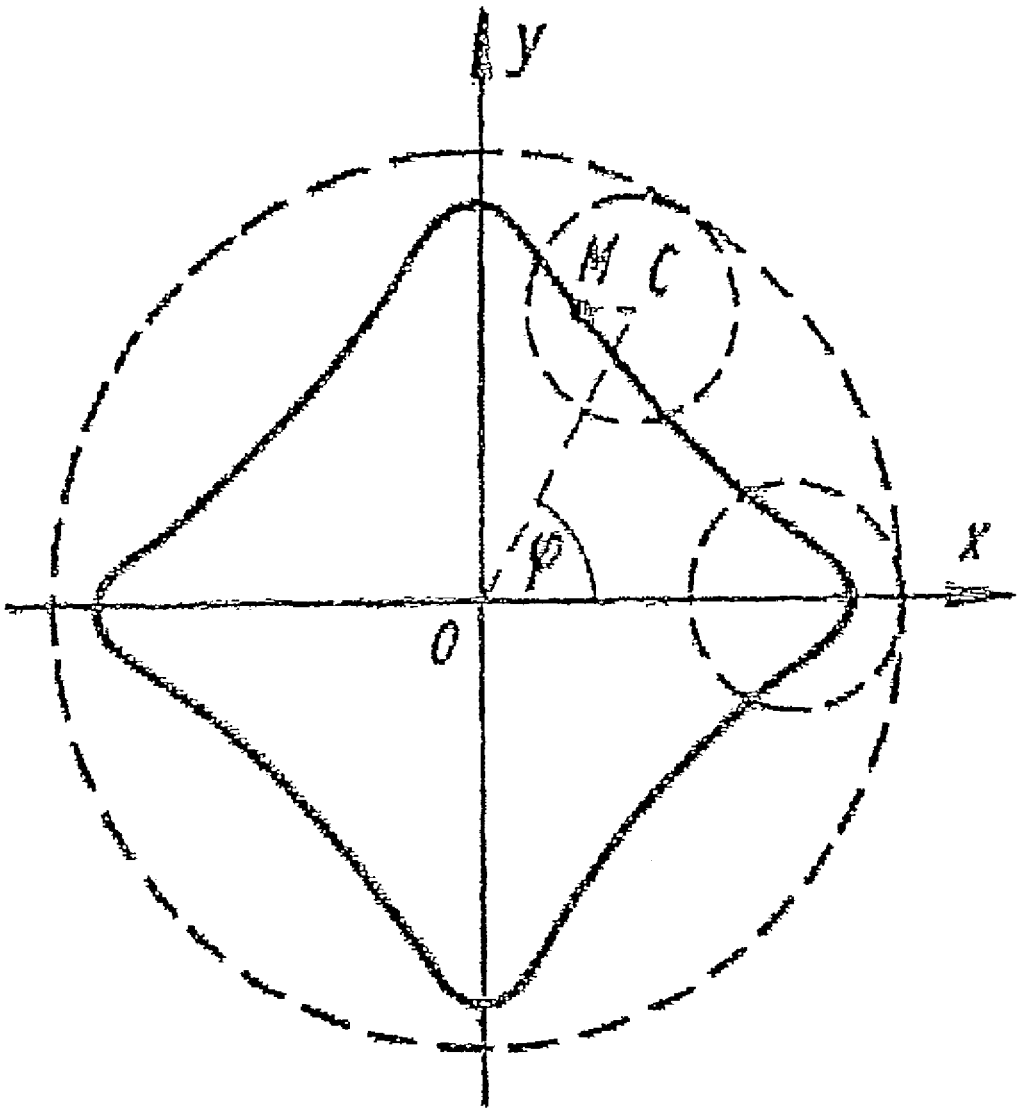
FIG. 4 schematically shows the development of a shortened hypocycloid.

If a point on the wheel is regarded that is situated radially further inward, closer to the rotational axis of the wheel, this is referred to as a shortened hypocycloid, shown in FIG. 4.

In the second specific embodiment, the movement shape of the hypocycloids can be advantageously used to mechanically control the longitudinal movement of blades 7.

Figure 8:
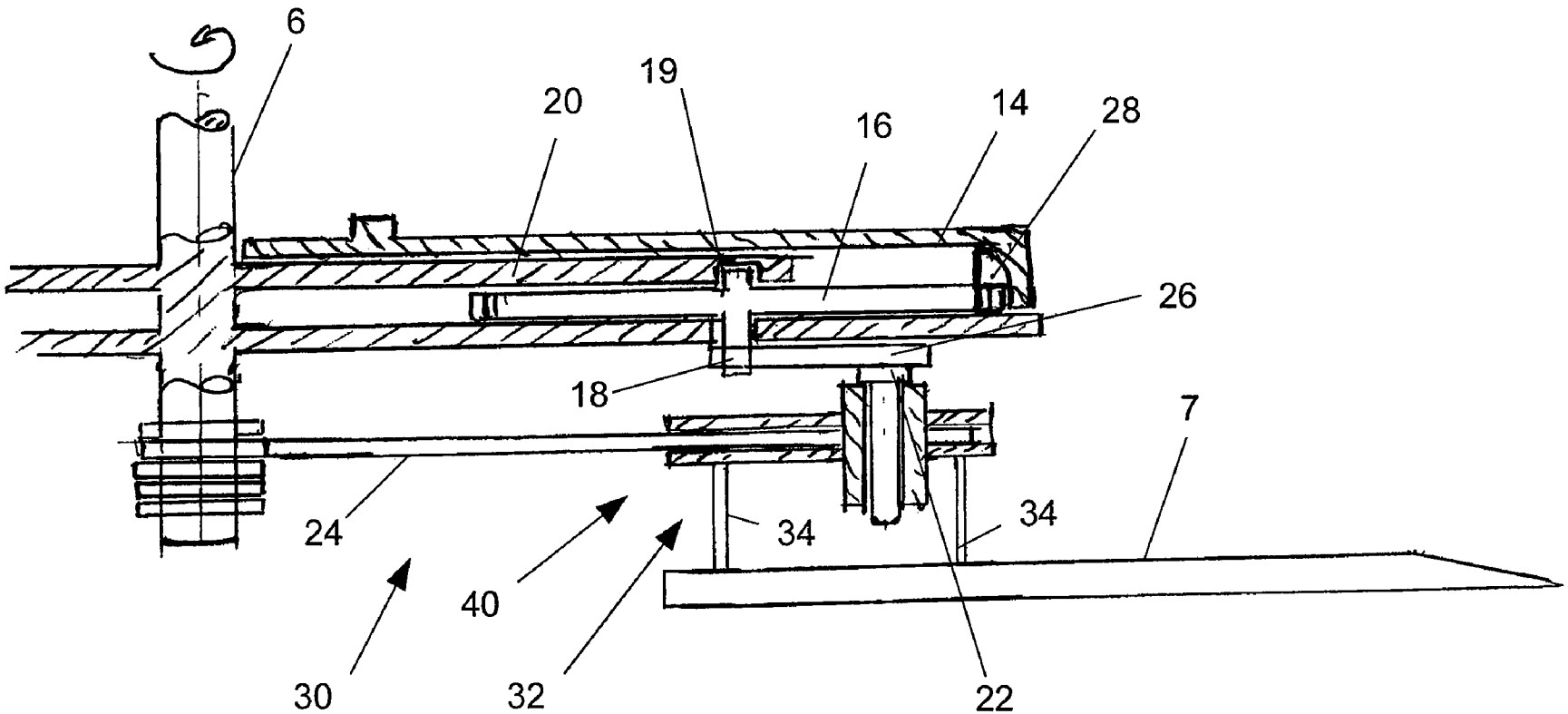
FIG. 8 shows a cross sectional view of a hypocycloid transmission of the present invention.
Figure 9:
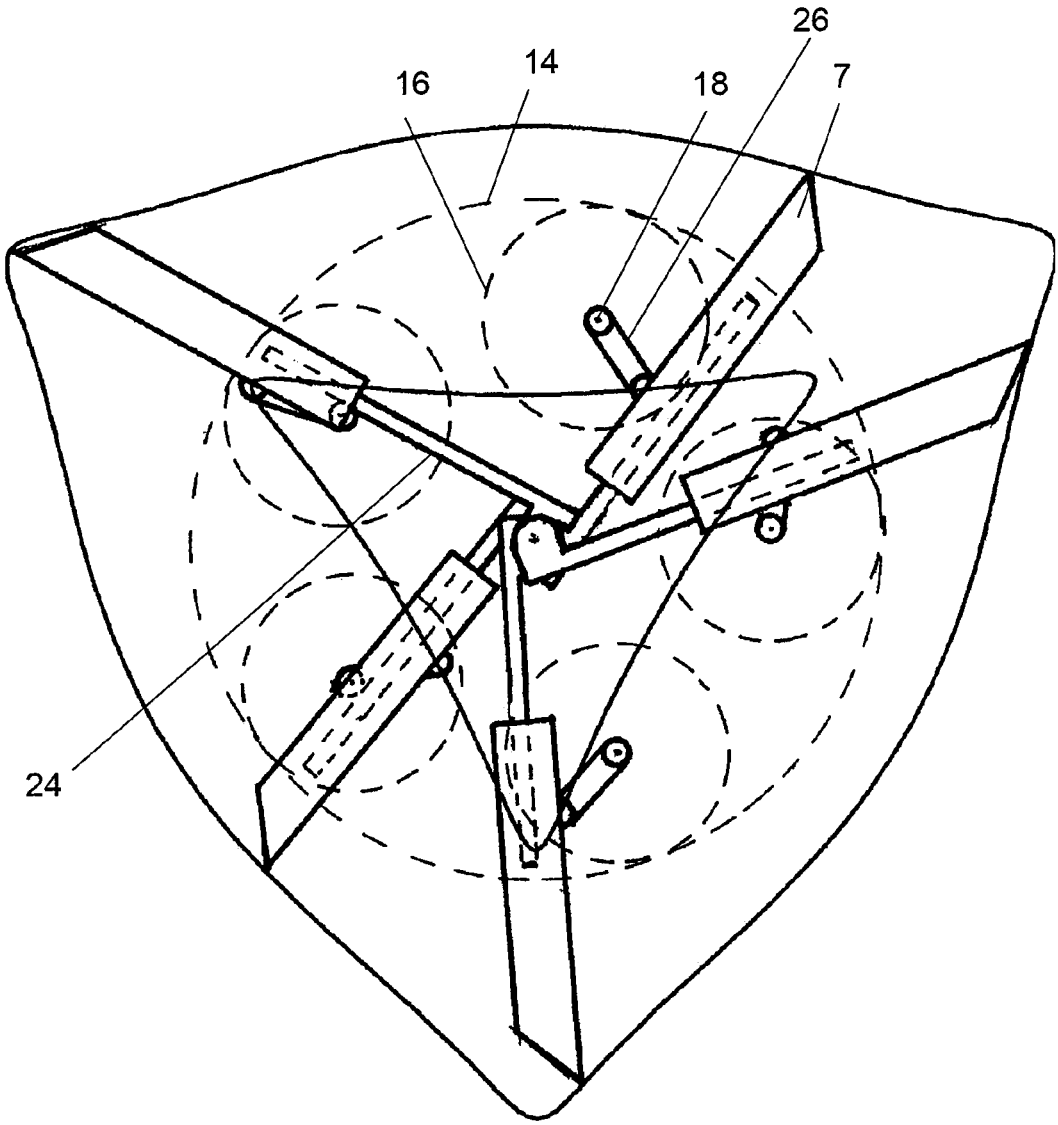
FIG. 9 shows a bottom plan view of the hypocycloid transmission of FIG. 8.

For this purpose, as seen in FIGS. 8 and 9, on frame 1 there is fastened a toothed 28 hollow wheel 14 whose center axis coincides with the axis of rotation of drive shaft 6. Inside the hollow wheel 14, there rotate a plurality of inner wheels 16, each of which is allocated to one of the blades 7, and which mesh with the hollow wheel 14. It is possible to have six or fewer inner wheels 16 rotating in a hollow wheel 14. If more than six inner wheels 16 are required, these should rotate in a plurality of parallel planes.

The small inner wheels 16 rotating on the inside are situated on a disk 20 having a plurality of bearing points 19 distributed over its periphery, and are driven by this disk 20 about an axis (drive shaft 6) in the center of the hollow wheel 14. The bearing points 19 are situated on the disk 20 in such a way that the inner wheels 16 run fixedly in the hollow wheel 14.

The individual blades 7 are fastened approximately in their center to tappets 26 of the inner wheels 16, via rotary bearings 22. Corresponding to the theory of the shortened hypocycloid, the linking tappets 26 on the inner wheels 16 are positioned not all the way at the edge of these wheels, but rather somewhat further inward.

The inner ends of blades 7 should essentially align with the center line of the rotary drive (drive shaft 6). Blades 7 can be guided there with sliding elements, with a connecting link 24.

So that, in their extended position, blades 7 can really be moved up to the wall that bounds the surface that is to be compacted, it is useful if the cover, which is required for safety reasons, e.g. safety cage 8, is constructed so as to be able to be partially folded up or pushed back slightly.

Figure 5:
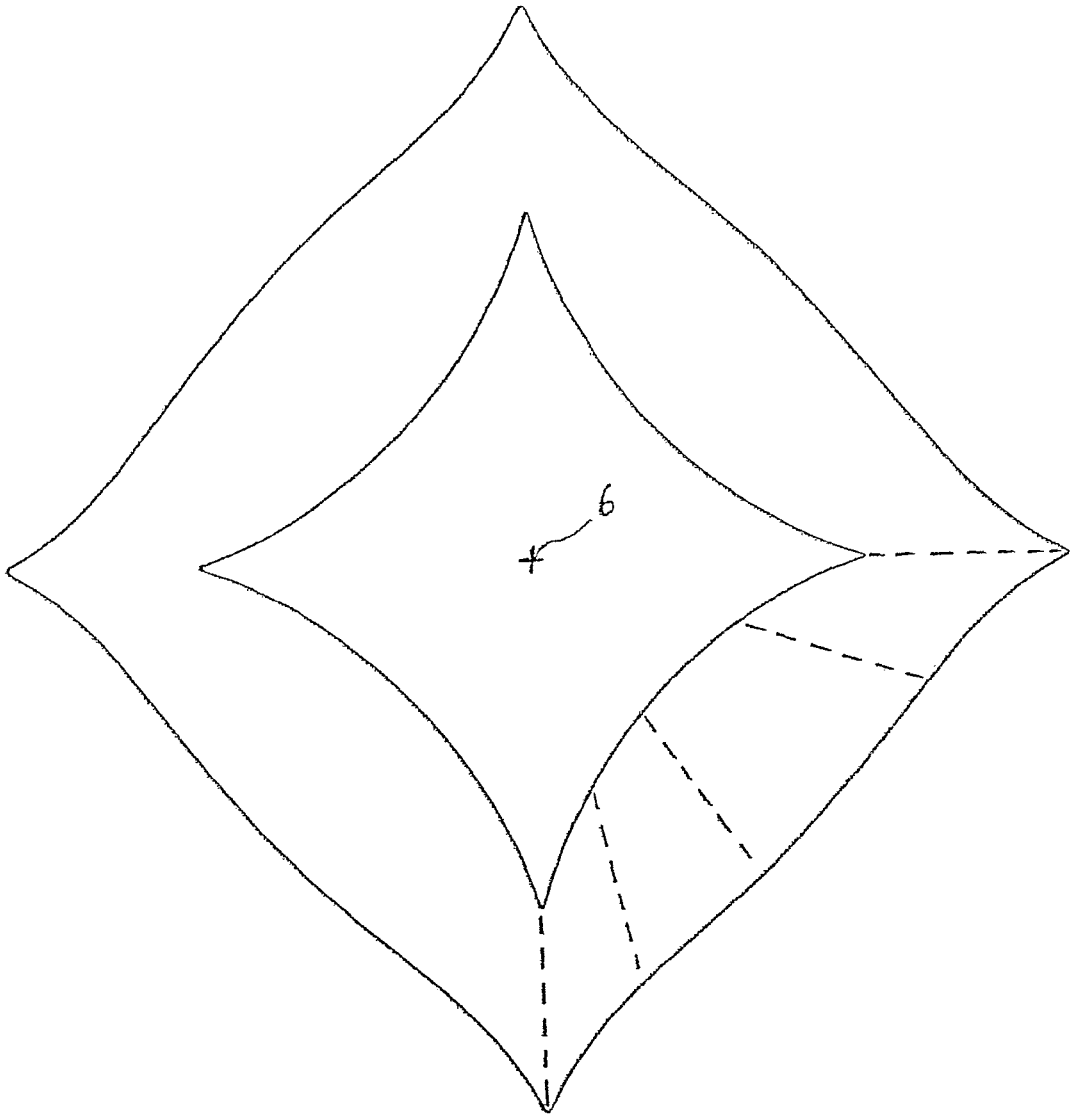
FIG. 5 shows a movement line of a blade assembly in a second specific embodiment of the present invention.

FIG. 5 shows the movement shape of a blade collar for a hypocycloid having four lobes. The inner curve represents the movement line of the hypocycloid that blade 7 describes via the guide point. The outer curve is the movement line of the blade tips during the rotation of blades 7 about drive shaft 6. The various positions of blades 7 are shown schematically by dotted lines, as examples.

Figure 6:
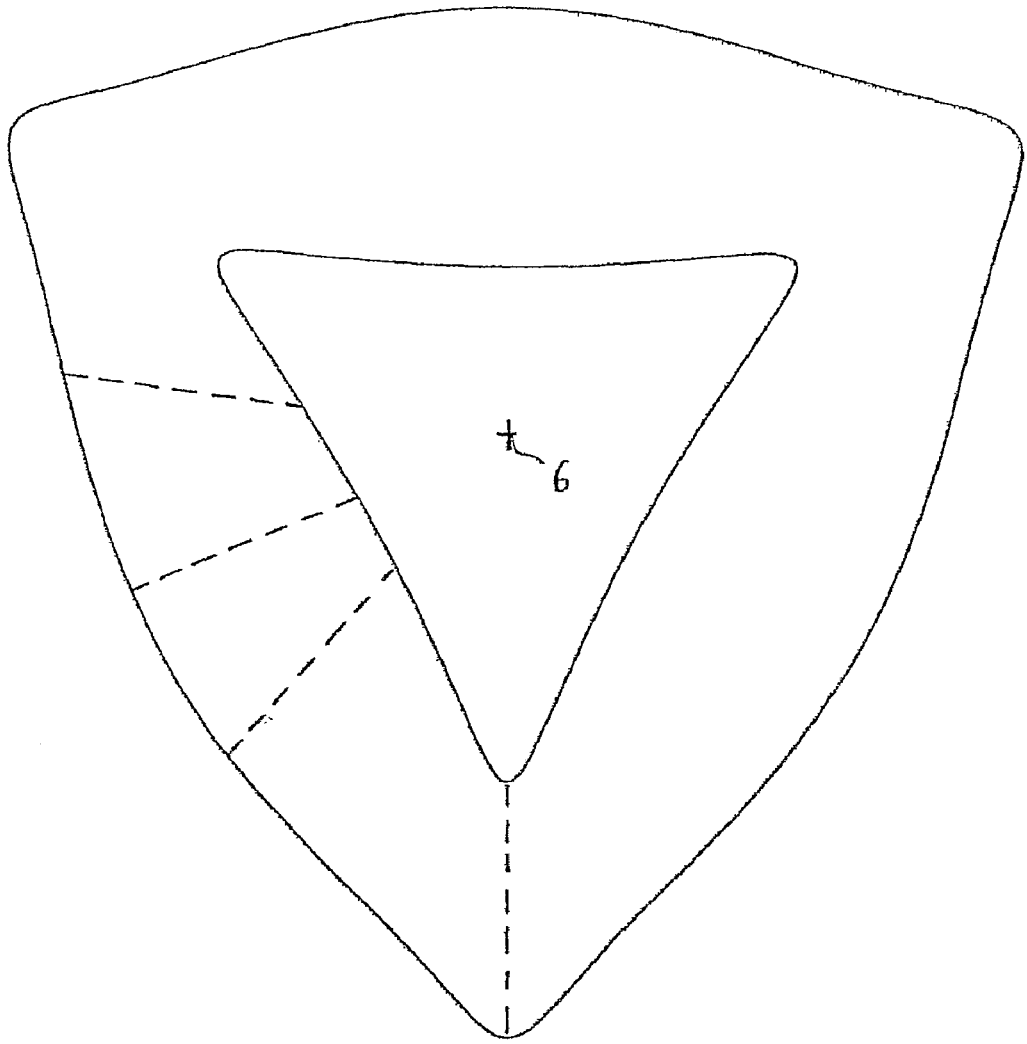
FIG. 6 shows a movement line in a variant of the second specific embodiment of the present invention.

FIG. 6 shows a hypocycloid having three lobes, in which the inner wheels 16 have a diameter of one-third of the hollow wheel 14. Here as well, for illustration various blade positions during a rotation about the rotational axis of drive shaft 6 (shown only schematically) are indicated. It can clearly be seen that it is easily possible to move the power trowel into a corner that is to be smoothed with one of the tips formed by the hypocycloid.

In designing the blade deflection device 30, care must be taken that the smoothing edge present on each blade 7 does not at any time execute a backward movement. Even a slight displacement opposite the forward direction of movement could cause the smoothing edge to dig a groove into the surface that is to be compacted, damaging the final smoothing result.

In a variation of the second specific embodiment of the present invention, the guide points on the inner wheels 16, or the tappets 26 provided there, are situated on the inner wheels 16 so as to be able to be displaced. When the tappets 26 are pushed into the center of the inner wheels 16, i.e., to the location of the axes of rotation, blades 7 execute the familiar circular movement of a classical power trowel.

In a further variation of the present invention, also shown in FIG. 8, each blade can be suspended on an oscillating lever device 32 that enables a radial displacement of the blades along their longitudinal axes. The radial displacement is produced via a connecting link 24 whose shape can be freely constructed. The shape of the connecting link 24 can for example correspond to a hypocycloid as described above. However, it need not be constructed with three or four lobes. The oscillating lever device 32 can preferably have, for each blade, two oscillating levers 34 that bear the blades.

The torque for the rotational movement of drive shaft 6 is transmitted to the respective blade via the two oscillating levers 34.

In this specific configuration, it can be regarded as advantageous that due to the connecting link the movement path of blades 7 can be more freely realized, and that blades 7 need be moved out of their circular path e.g. only for only one "tip". However, because the forces acting on the power trowel are then no longer symmetrical due to the different frictional conditions, the danger would arise that the power trowel would drift laterally, which would be undesirable. Therefore, it is advantageous if the movement of a blade on the opposite side (relative to the drive shaft) is counteracted by a countermovement of another blade.

Figure 7:
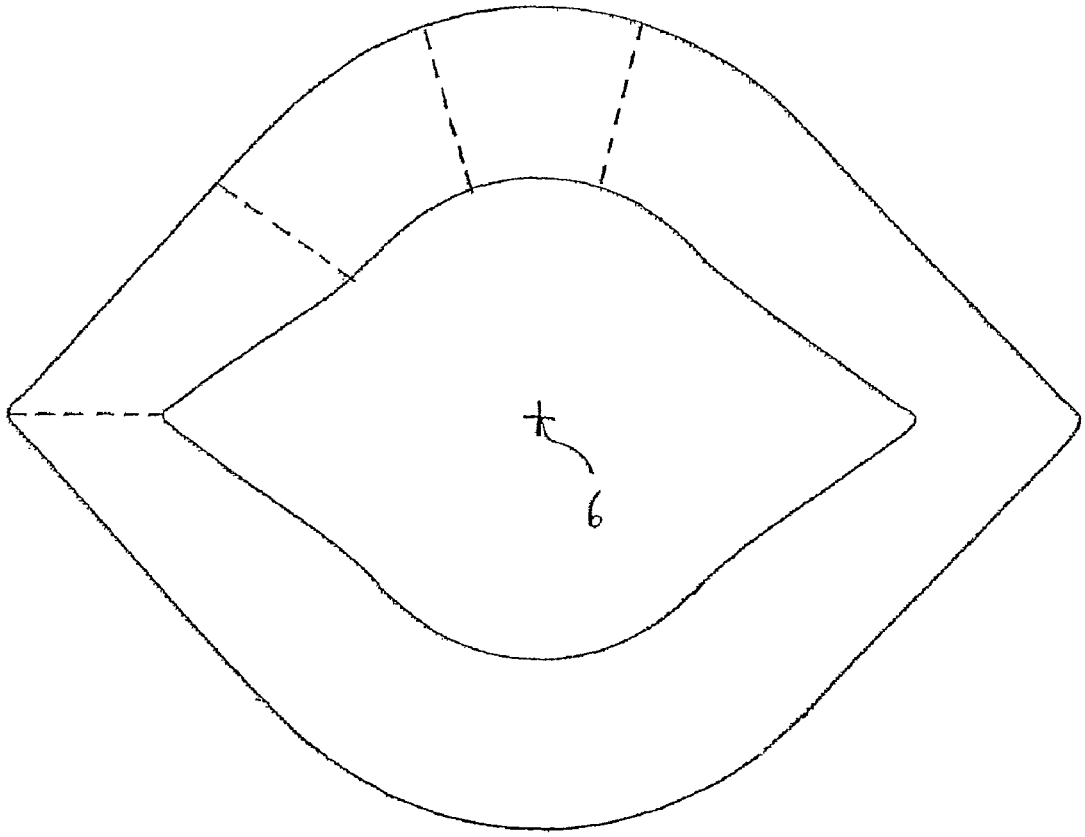
FIG. 7 shows a movement line of a blade assembly in a third specific embodiment of the present invention.

In FIG. 7, such a movement picture is shown. The inner curve describes a possible connecting link curve that the outer contour effects if the blades are displaced purely radially during their rotational movement. The outer contour in turn corresponds to the surface that is to be swept over by the blade. In FIG. 7 as well, dotted lines indicate different blade positions.

This specific configuration of the present invention has the advantage that almost arbitrary corner angles can be realized.

An angle less than 90° can be advantageous for the operator, because with such an angle the operator can move even into very narrow corners.

In addition, in this specific embodiment there is the possibility of compensating forces through different, e.g. asymmetrical, connecting link shapes. In riding power trowels having two rotors (FIG. 1), it is easily possible to obtain the counterforce required for the radial deflection of a blade from the inclination of the counter-axis.

In another specific embodiment of the present invention (not shown), the blades that are to be moved are radially displaced via individually controllable power drives. These power drives can for example be hydraulic cylinders or electrical actuators.

The transmission of energy from frame 1 to the rotating drive shaft 6 can take place at a suitable point. For the precise positioning of a blade dependent on its rotational position, a control device is provided that is able to individually control the power drive of each blade. The control device can also be coupled to a processor for the rotary drive in order to synchronize the movement of the blades with the rotational movement. With the aid of the control device, it can be possible to select a conventional circular movement of the blades, or a "corner movement." In the compressing of larger surfaces, in some circumstances it is undesirable or unnecessary over large distances for the blades to follow a path that deviates from a circular movement. It can then be useful only in the vicinity of the corners to modify the movement profile of the blades with the aid of the control device.

In a particular further development of the fourth specific embodiment of the present invention, distance sensors can recognize the distance from the boundary walls, and can thus correspondingly control the blade position. In particular, given a precise recognition of the distance it is possible to deflect each of the blades radially just far enough that its tip travels just against the wall, but not more or less far than this. When smoothing a surface close to a wall, this makes the work significantly easier for the operator, because he does not have to exercise the high degree of care that was previously necessary in order to achieve a precise smoothing of the area up to the wall. The corners can also be smoothed in this way from any approach position, so that even corners having angles other than 90° can be processed quickly and efficiently.

I claim:

1. A power trowel, comprising:

a frame that can be moved over a surface that is to be smoothed;

a drive;

at least one rotor that is held on the frame and that has a drive shaft driven rotationally by the drive, as well as a plurality of blades held on the drive shaft, the power trowel sitting on the surface with the blades; and a blade deflection device that is coupled to at least one of the rotor and the blades and that is selectively operable at least indirectly to move the blades so that the blades, when rotated by the drive shaft, are moved along a path that deviates from a circular path relative to the drive shaft.

2. The power trowel as recited in claim 1, wherein the rotor is able to be deflected periodically by the blade deflection device from a null position in which the blades describe in their rotation a circular path relative to the surface.

3. The power trowel as recited in claim 2, wherein the period of the deflection corresponds to one of one time, two times, three times, or four times the frequency of the rotational speed of the blades.

4. The power trowel as recited in claim 1, wherein at least the outer ends of the blades are covered by a protective covering that flexes in response to the action of an external force.

5. The power trowel as recited in claim 1, wherein each blade is able to be moved by the blade deflection device along its longitudinal axis relative to the drive shaft.

6. The power trowel as recited in claim 1, wherein each of the plurality of blades is elongate, having a non-circular perimeter shape.

7. The power trowel as recited in claim 6, wherein, as the plurality of elongate blades rotate through an entire revolution, an end of each of the plurality of elongate blades.

8. A power trowel, comprising:

a frame that can be moved over a surface that is to be smoothed;

a drive;

at least one rotor that is held on the frame and that has a drive shaft driven rotationally by the drive, as well as a plurality of blades held on the drive shaft, the power trowel sitting on the surface with the blades; and a blade deflection device by which the blades, when rotated by the drive shaft, are moved along a path that deviates from a circular path relative to the drive shaft, wherein the blade deflection device has a hypocycloid transmission, having a hollow wheel, held on the frame, whose mid-axis coincides with the axis of rotation of the drive shaft, a plurality of inner wheels, each of which is allocated to one of the blades, and which rotate inside the hollow wheel, a wheel bearing element that bears the inner wheels, and having a guide device by which, for each blade and associated inner wheel, a radial component, relative to the axis of rotation of the drive shaft, of the movement of a guide point provided on the side of the respective inner wheel is able to be transmitted to the associated blade.

9. The power trowel as recited in claim 8, wherein the inner diameter of the hollow wheel is larger by a whole-number multiple than the outer diameter of the inner wheels.

10. The power trowel as recited in claim 8, wherein the hollow wheel and the inner wheels each have a toothing, and the inner wheels mesh with the hollow wheel.

11. The power trowel as recited in claim 8, wherein, for each of the inner wheels, the radial distance of the respective guide point from the axis of rotation of the inner wheel is able to be adjusted to a plurality of different positions.

12. The power trowel as recited in claim 8, wherein each of the guide points is able to be adjusted to the location of the axis of rotation of the respective inner wheel.

13. The power trowel as recited in claim 8, wherein the guide device has tappets that are fastened to the inner wheels at the guide points and that engage in the blades.

14. The power trowel as recited in claim 8, wherein the blades are guided in a connecting link at their end oriented towards the drive shaft.

15. A power trowel comprising:

a frame that can be moved over a surface that is to be smoothed;

a drive;

at least one rotor that is held on the frame and that has a drive shaft driven rotationally by the drive, as well as a plurality of blades supported on the drive shaft, the power trowel sitting on the surface with the blades; and a blade deflection device by which the blades, when rotated by the drive shaft, are moved along a path that deviates from a circular path relative to the drive shaft, wherein the blade deflection device has a connecting link guide situated coaxially to the drive shaft, and has for each blade a respective oscillating lever device;

each blade is guided along its longitudinal axis on the oscillating lever device allocated to the blade; and the oscillating lever device is guided in the connecting link guide in such a way that a radial component, relative to the axis of rotation of the drive shaft, of the movement that the connecting link guide compels the oscillating lever device to execute is transmitted to the respective blade guided by this oscillating lever device.

16. A power trowel, comprising:

a frame which can be moved over a surface that is to be smoothed;

a drive;

at least one rotor that is supported on the frame and that has a drive shaft that is driven rotationally by the drive about an axis, and a plurality of elongate blades that are mounted on the drive shaft and that support the power trowel on the surface; and a blade deflection device which is coupled to the blades and that selectively moves the blades relative to the drive shaft, wherein, when the blades are rotated by the drive shaft through rotation of the drive shaft about its axis, the blade deflection device can be operated to cause the blades to move along a path that deviates from a circular path relative to the drive shaft.

17. The power trowel as recited in claim 16, wherein the blade deflection device drives each blade to move along its longitudinal axis relative to the drive shaft.

18. The power trowel as recited in claim 16, wherein the deflection device comprises one of:

a hypercycloid drive that couples the blades to the rotor, a plurality of oscillating lever devices, each of which suspends a respective blade from the rotor, and a plurality of power drives, each of which drives a respective blade to move radially relative to the rotor shaft.

19. The power trowel as recited in claim 16, wherein the power trowel has at least first and second rotors that are supported on the frame in a spaced apart relationship, each rotor having a drive shaft that is driven rotationally by the drive, a plurality of elongate blades that are mounted on the drive shaft and that support the power trowel on the surface; and a blade deflection device which is coupled to the blades.

20. The power trowel as recited in claim 19, wherein the power trowel is a riding trowel having an operator's seat.

21. The power trowel as recited in claim 16, wherein the blade deflection device extends between and connects the drive shaft and the plurality of elongate blades to each other.

22. The power trowel as recited in claim 21, wherein the blade deflection device pushes at least one of the plurality of elongate blades into a corner such that a movement path of the at least one of the plurality of elongate blades includes a non circular point or tip.

23. A power trowel, comprising:

a frame that can be moved over a surface that is to be smoothed;

a drive;

at least one rotor that is supported on the frame and that has a drive shaft that is driven rotationally by the drive, and a plurality of elongate blades that are mounted on the drive shaft and that support the power trowel on the surface; and blade deflection device means for causing the blades to move relative to the drive shaft so that the blades move along a path that deviates from a circular path relative to the drive shaft while the drive shaft and blades are rotating.

* * * * *